US005343925A

United States Patent [19]

Hannerstig

[11] Patent Number: 5,343,925

[45] Date of Patent: Sep. 6, 1994

[54] DEVICE FOR DRAPING CURTAINS

[75] Inventor: Christer Hannerstig, Hollviksnas, Sweden

[73] Assignee: AB A. Svensson & Co., Malmö, Sweden

[21] Appl. No.: 910,012

[22] PCT Filed: Sep. 27, 1991

[86] PCT No.: PCT/EP91/01858

§ 371 Date: Sep. 8, 1992

§ 102(e) Date: Sep. 8, 1992

[87] PCT Pub. No.: WO92/11792

PCT Pub. Date: Jul. 23, 1992

[30] Foreign Application Priority Data

Jan. 7, 1991 [DE] Fed. Rep. of Germany ..... 4100282
Apr. 5, 1991 [DE] Fed. Rep. of Germany ..... 4111067

[51] Int. Cl.[5] ..... A47H 13/14
[52] U.S. Cl. ..... 160/348; 160/349.2
[58] Field of Search ..... 160/38, 349.2, 348, 160/330, 39, 380, 392; 428/4; 223/46, 44; 29/453, 525.1; 38/102.2

[56] References Cited

U.S. PATENT DOCUMENTS 1,831,169 11/1931 Geraldine ..... 160/349.2 X
1,868,944 7/1932 Jones .
1,933,691 11/1933 Young ..... 160/349.2 X
2,365,664 12/1944 Troensegaard et al. .
2,498,925 2/1950 Lind .
2,563,306 8/1951 Burrage .
4,559,988 12/1985 Nocerino ..... 160/349.2
4,912,829 4/1990 Hickey ..... 160/349.2 X
5,144,997 9/1992 Marasco et al. ..... 428/4 X

FOREIGN PATENT DOCUMENTS 0265759 10/1987 .
2247827 3/1992 United Kingdom ..... 160/349.2

*Primary Examiner*—Blair M. Johnson

[57] ABSTRACT

A device for draping curtains, comprising a holder (10) about which curtain fabric may be put and which is adapted to be mounted on a wall by means of a bracket (11) in spaced relationship to the wall such that the plane defined by the holder (10) extends approximately parallel to the wall. The holder (10) is constituted by a round or flat bar bent to meander shape.

13 Claims, 7 Drawing Sheets

FIG.3
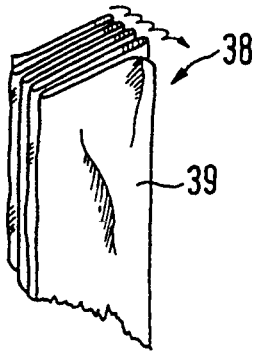
FIG.4
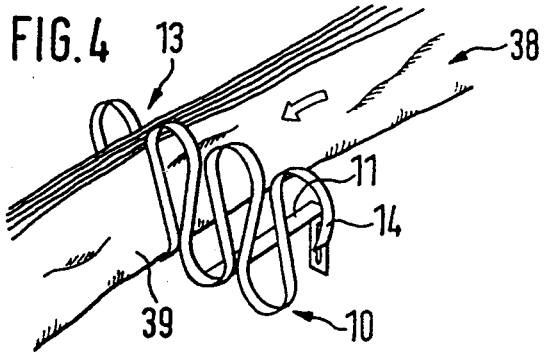
FIG.5
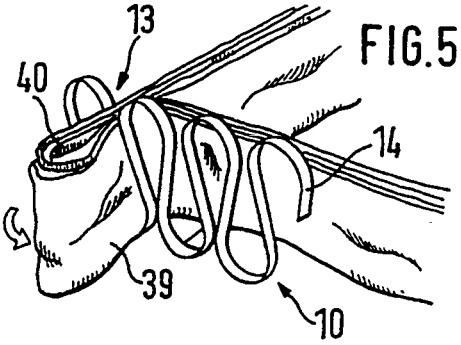
FIG.6
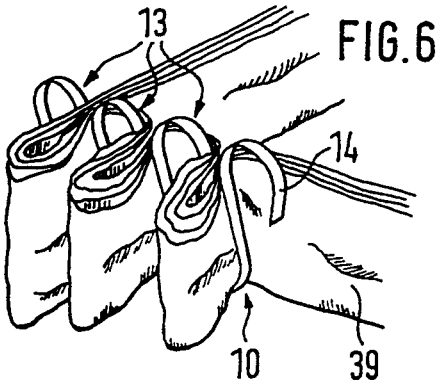
FIG.7
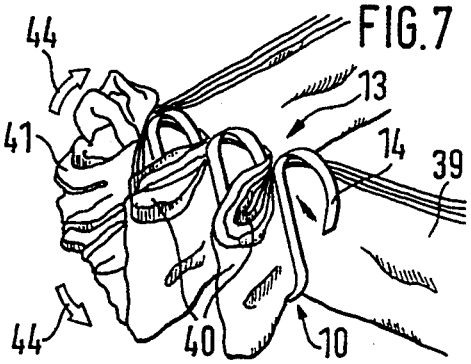
FIG.8
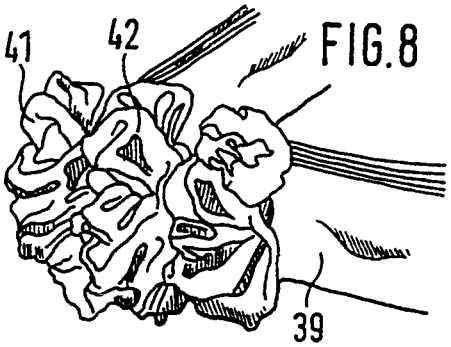
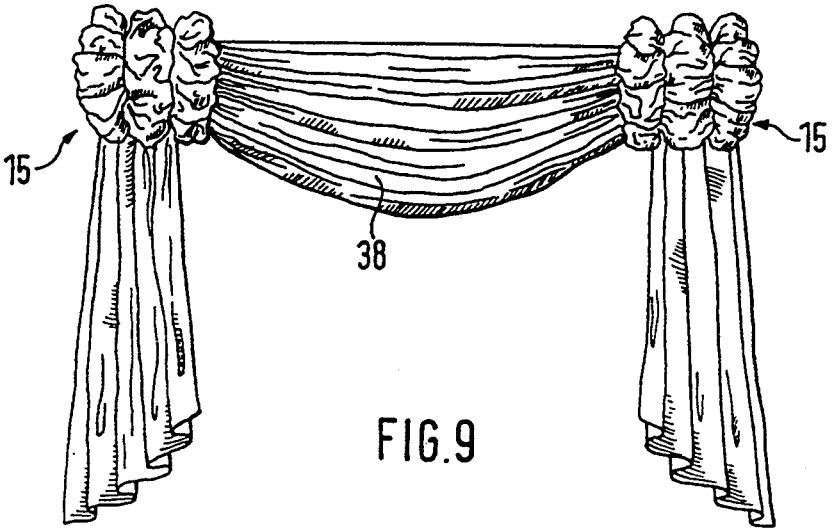
FIG.9

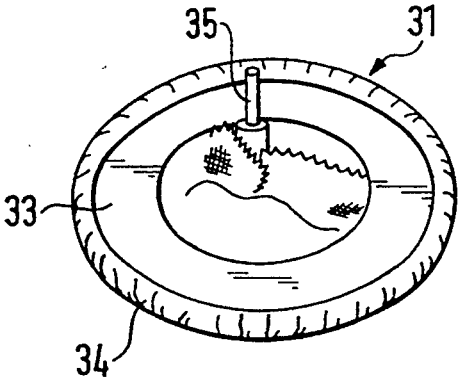
FIG.15
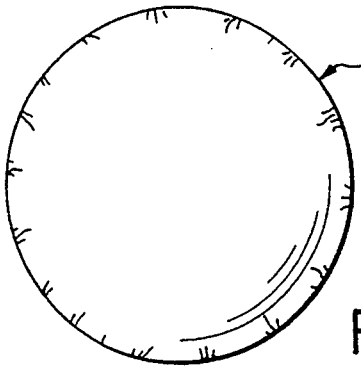
FIG.16
FIG.17
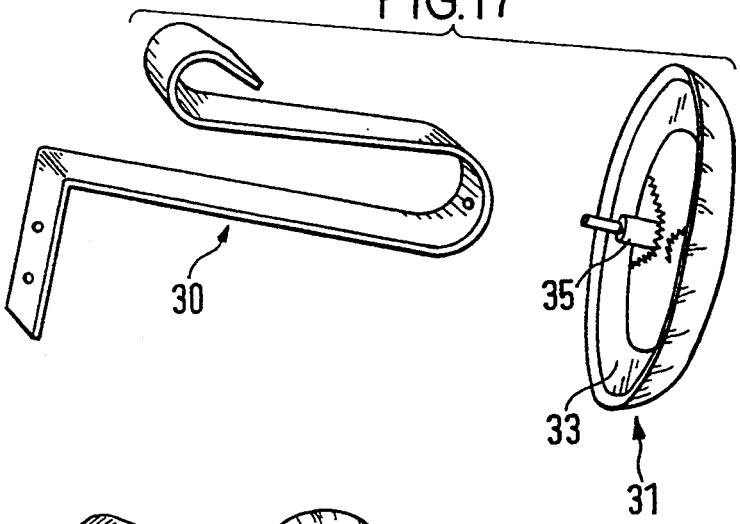
FIG.18
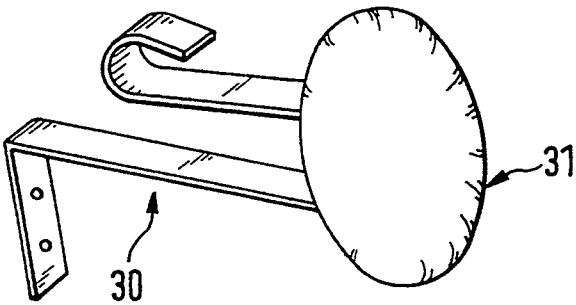
FIG.19
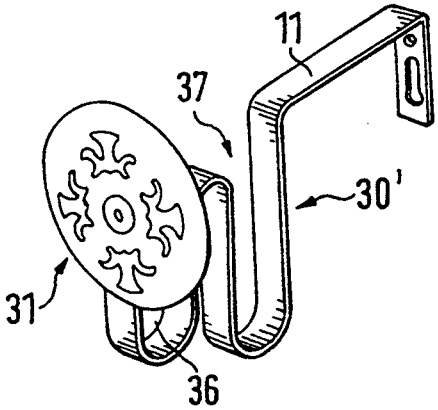

DEVICE FOR DRAPING CURTAINS

BACKGROUND OF THE INVENTION

The invention is directed to a device for draping curtains, comprising a holder about which curtain fabric can be placed and which by means of a bracket can be mounted on a wall in spaced relation thereto such that the plane defined by the holder extends approximately parallel to said wall, and the invention is further directed to a method of draping curtains by using devices of the aforementioned kind.

For draping of a window or door curtain the curtain fabric is folded to form a bar-like bundle (concertina or meander fold) and is put over two holding rods mounted in horizontally spaced relationship above the window or the door. Then, to create a draped bow between the two holding rods, the lower portion of the curtain fabric is pulled down whereby circular segment-like folds are formed; here it is extremely difficult and requires great skill to keep the topmost fold or folds taut between the two holding rods. To this end U.S. Pat. No. 2,588,246 provides a separate holding pin on each holding rod between which pin and the holding rod the curtain fabric is to be firmly clamped. But such a simple clamping means does not offer any firm hold.

DESCRIPTION OF THE BACKGROUND ART

It is known from U.S. Pat. No. 2,244,129 to drape curtain fabric through rings which extend normal to the wall, the rings in this case being closed rings. Within said rings the curtain fabric is, however, held rather poorly; above all it is difficult permanently to maintain a predetermined folding of the curtain fabric.

According to the proposal of U.S. Pat. No. 2,431,934 the curtain is also draped through rings which, however, each extend parallel to the wall. In this embodiment it is likewise not ensured that a predetermined folding is maintained.

In order to avoid the above-mentioned problems the applicant's EP-B-265,759 has proposed a device which is characterized by at least one and especially two mutually horizontally spaced and approximately U-shaped holders over the upper leg or legs of which—in the mounted state—and between the upper and lower leg or legs of which a curtain fabric, which has been folded to a bar-like or board-like bundle, may be passed in such a way that the curtain fabric is firmly held while a predetermined draping is maintained. Alternatively, a device for draping curtains is proposed which is characterized by at least one and especially two mutually horizontally spaced holders bent to approximate U-shape or C-shape, which holder or holders are mounted on a wall at such a spacing therefrom that the plane defined by the two legs or tines of the holder extends approximately parallel to the wall surface. Preferentially, the two legs of each holder are adapted to be resiliently spread apart. The bracket for the holders is normally L-shaped.

OBJECT OF THE INVENTION

The instant invention is based on the object of further improving the last-mentioned device and the associated method of draping curtain fabric such that an alternative result of draping is obtained. In accordance with the invention it is also intended to provide more possible ways of draping or draping variations.

The specified object is achieved by a device according to claim 1, alternatively by a device according to claim 11 and, respectively, by a method according to claim 9, alternatively a method according to claim 16.

The device according to claim 17 enhances the decorative effect.

As compared with the prior art, the device according to claim 1 permits forming of an alternative rosette of curtain material in the vicinity of the holder in an extremely simple way, as will be apparent from claim 9 according to which the curtain fabric is initially meander-folded to form a fabric bar or board. Thereafter, the fabric bar is drawn forwards—starting on one side of the holder—through a first upwardly open C-shaped, U-shaped or tulip-like holder profile and is then passed back through said profile to form a fabric loop. Thereafter, curtain fabric is drawn forwards through the next-following upwardly open holder profile and passed back in the same way as described above. This operation is repeated until all profiles of the holder are similarly filled with curtain fabric. Then, the fabric loops are fanned out towards the top and bottom and are turned back upon the respective legs which define the associated holder profiles, whereby puffs or rosettes of fabric are formed.

As an alternative, the curtain fabric may first be pulled intermittently through the first holder profile and turned back upon the legs defining said profile, and the same operation is then carried out with the second and the next-following holder profiles.

Preferred structural improvements of the above-mentioned device are described in claims 2 to 9, in which the structures according to claims 7 and 8 offer additional variations in respect of the fabric rosette and draping to be created.

The alternative device according to claim 11 is defined by a holder which comprises a thin-walled disk of sheet metal, cardboard or synthetic plastic with an approximately star-shaped opening through which the curtain fabric is draped.

Such a draping device is known in conjunction with a ring-like (closed annulus) holder. It is sold under the name "Kirsch Swag Holder". With the known device, the rays of the star-shaped opening are defined by radial slots. Accordingly, the aforementioned disk is used only for fixing the curtain fabric draped through the ring-like holder within the ring so as to avoid the problems mentioned above in conjunction with U.S. Pat. Nos. 2,244,129 and 2,431,934. Curtain material can therefore not be draped through the slots of the star-like opening of the prior art.

This is to be possible with the invention due to the feature that the rays of the star-like opening have a width which corresponds to approximately 1/20 to 3/20, especially approximately 2/20 of the mean holder diameter.

The details set out in claims 12 to 15 permit the achievement of additional draping effects such as, for instance, a plurality of discrete rosettes in the front area of the holder.

BRIEF DESCRIPTION OF THE DRAWINGS

Below, embodiments of the device according to the invention and corresponding draping methods will be explained in detail with reference to the accompanying drawing, in which:

FIGS. 3 to 8 are explanatory views of a draping operation by making use of a device according to FIGS. 1 and 2;

FIG. 9 is a front view of a curtain draped by using two holders according to FIGS. 1 and 2;

FIGS. 14 and 15 are perspective rear views of the cover illustrated in FIG. 13, showing the fixing of curtain fabric which has been pulled over the front of the cover;

FIG. 16 is a front view of the cover according to FIG. 15;

FIG. 17 is a perspective view of the cover cooperating with a draping device;

FIGS. 18 and 19 are respective perspective views of the cover shown in FIGS. 15 and 16 mounted on the front of a draping device;

Figure 1:
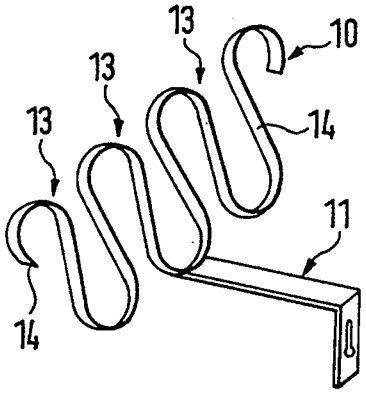
FIG. 1 is an oblique perspective view from below of a first embodiment of a draping device according to the invention.
Figure 2:
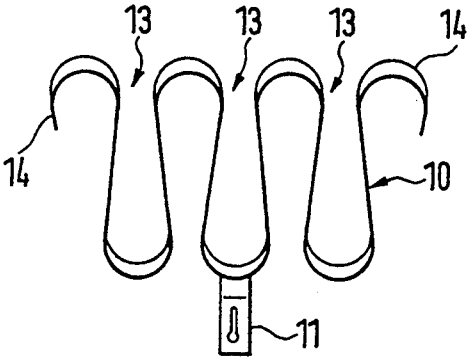
FIG. 2 is a slightly oblique front view from below showing the draping device of FIG. 1.

The device for draping curtains as illustrated in FIGS. 1 and 2 is composed of at least one and especially two holders 10 which are disposed at a mutual horizontal spacing above a window or door or the like and about which curtain fabric may respectively be put and which are each adapted to be mounted on a wall by means of an L-shaped bracket 11 at such a spacing from the wall that the plane respectively defined by the holders 10 extends approximately parallel to the wall. Each holder 10 is constituted by a flat bar bent to meander shape. In the illustrated embodiment the flat bar—a round bar could likewise be employed—is bent such that three upwardly open and two intermediate downwardly open tulip profiles 13 are formed. The ends of the thus bent flat bar are turned down to form semicircular end segments 14. Preferentially, the free ends of the end segments 14 are bent right to the contiguous legs of the adjacent tulip profiles 13. In that case the end segments are nearly circular.

Furthermore, it is apparent from FIGS. 1 and 2 that the individual tulip profiles 13 are bent such that the profile ends almost abut one another. In an alternative embodiment they may even overlap one another in the plane defined by the holder. To facilitate insertion of the curtain fabric the legs of the individual profiles, in the instant case of the tulip profiles 13, of each holder 10 may be spread apart to be later returned to their original position for the purpose of fixing the curtain fabric within the respective profile. To this end, the individual profiles 13 are preferentially resiliently flexible.

Figure 10:
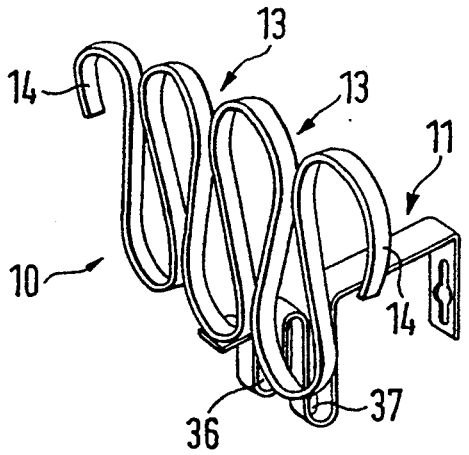
FIG. 10 is a perspective view of an alternative embodiment of a draping device according to FIG. 1.

The bracket 11 of each holder 10 is L-shaped as known per se. Preferentially, the leg of the bracket 11 which is respectively connected to the holder 10 is variable in length, i.e. it consists of two longitudinally relatively movable leg portions which are adapted to be fixed in a predetermined relative position by means of an attachment screw or the like. Additionally, the bracket 11 may be provided immediately behind the holder 10 with one or two (see FIG. 10) open-topped recesses 36, 37, the recess 37 next to the wall being deeper than the front recess 36.

In the illustrated embodiment the individual profiles 13 of the holder 10 are disposed along a straight line. Mounting on the wall is effected so that the extension of the individual profiles is horizontal. A vertical orientation is also conceivable.

It would also be conceivable to arrange the individual profiles 13 of the holder 10 along a semicircle or even a full circle. Thereby the number of possible variations of draping a curtain fabric is additionally increased. The bracket 11 is attached, preferentially by welding, to the lower connecting web of the central upwardly open individual profile 13.

Curtain fabric may be draped as follows by making use of a device shown in FIGS. 1 and 2:

a) First of all, the curtain fabric is concertina-folded or meander-folded to create a fabric bar or board 39 (see FIG. 3).

b) Then, starting from one side of the holder 10 and according to FIG. 4 starting on the left side of the holder 10, curtain fabric 38 or the fabric bar 39 is pulled through a first upwardly open tulip profile 13 towards the front and is passed back through said profile to form a first fabric loop 40.

c) Then, curtain fabric 38 or fabric bar 39 is pulled forwards through the next-following upwardly open holder profile 13 and, as described above, passed back to thereby form another fabric loop 40. This operation is continued until all tulip profiles 13 are similarly provided with curtain material (FIG. 6).

d) Then, again starting on the left side of the holder 10, the first fabric loop 40 is fanned out towards the top and bottom (arrows 44) and turned back over the legs of the first or extreme-left holder profile 13. Thereafter, the next-following fabric loop 40 is fanned out and turned back over the legs defining the next-following holder profile 13 to thereby form another fabric puff 41, etc., until all fabric loops 40 have similarly been turned back over the legs of the individual holder profiles 13, as will be apparent from FIG. 8. The result is illustrated in FIG. 9, in which two horizontally spaced holders 10 of the afore-described kind disposed above a non-illustrated window or the like have been draped as described above.

Draping with the holders 10 may also be performed in a modified way, for instance intermittently, so that starting on one side of the holder 10 a complete fabric puff 41 is initially formed on the first holder profile 13 whereafter the curtain fabric is pulled forward through the next-following holder profile 13 to thereby form fabric loop 40 and to form another fabric puff 41, etc. In the final analysis, the kind of draping depends on the user of the device illustrated in FIGS. 1 and 2, the draping method shown in FIGS. 4 to 8 probably being the easier draping method.

The fabric rosette created in accordance with any one of the aforementioned methods is indicated at 15 in FIG. 9.

As already explained above, the holder profiles 13 may be designed so that they can be flexed apart to facilitate insertion and/or passing-through and turning-back of the curtain material, whereafter they may be bent back to fixedly clamp the curtain fabric to the holder.

As illustrated, the various holder profiles may be tulip-shaped, C-shaped or U-shaped.

Figure 11:
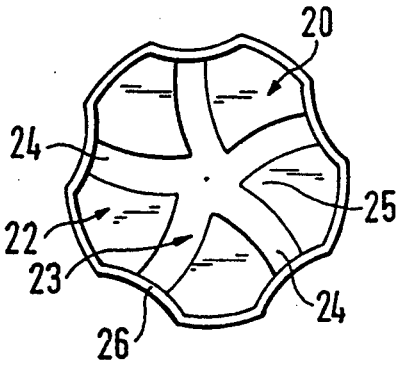
FIG. 11 is a plan view of another alternative draping device.
Figure 12:
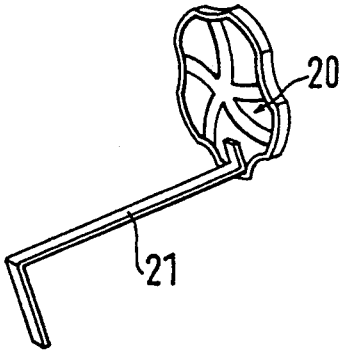
FIG. 12 is a perspective view of the draping device illustrated in FIG. 11.
Figure 13:
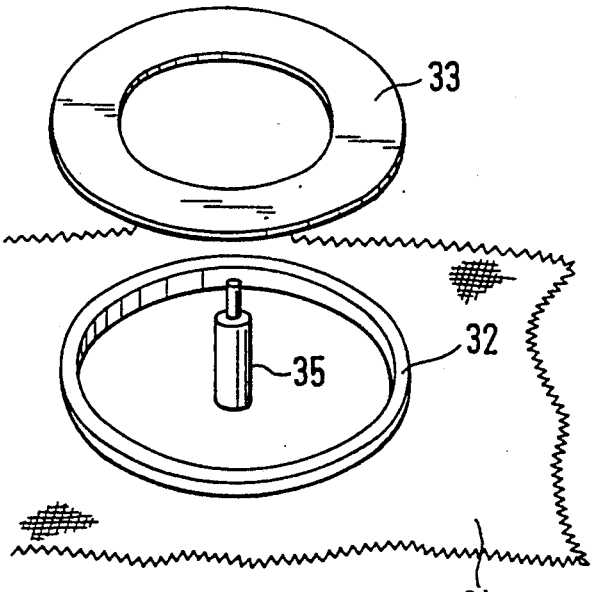
FIG. 13 is an exploded perspective view showing an embodiment for a front-side cover of a draping device.

FIGS. 11 and 12 illustrate an alternative device for draping curtains, comprising a holder 20 bent to ring shape about which curtain fabric may be put and which is adapted to be mounted on a wall in spaced relationship thereto by means of a likewise L-shaped bracket 21 so that the plane defined by the holder 20 extends approximately parallel to the wall. The leg of the bracket 21 joined to the holder is variable as to its length in the present embodiment, as illustrated in FIG. 12, in the same way as described in conjunction with the bracket 11.

The plane defined by the holder 20 is filled by a thin-walled draping plate or disk 22 made of sheet metal, cardboard or synthetic plastic, which is formed with an approximately star-shaped opening 23 through which curtain fabric can be drawn. The rays 24 of the star-shaped opening 23 are substantially wider than in the prior art. Preferentially, they have a width that corresponds approximately to between 1/20 and 3/20, especially approximately 2/20, of the mean holder diameter. In particular, each ray has a width between about 5 and 12 mm, especially of about 8 mm. In the illustrated embodiment the rays 24 of the star-shaped opening 23 terminate obtusely at the edge of the disk. Basically, it would also be conceivable that the rays terminate pointedly or alternately in pointed and obtuse shape.

The portions 25 of the draping disk 22 which are defined by the rays 24 of the star-shaped opening 23 and are triangular in the present case, are adapted to be either resiliently flexible or to be subject to plastic deformation, the first-mentioned design probably being the more feasible one. The last-mentioned design could at most be advantageous for some special kind of fixing of the curtain material, especially outside of the plane defined by the holder.

In the embodiment illustrated in FIGS. 11 and 12, the periphery of the holder 10 in the vicinity of each ray 24 of the star-shaped opening 23 comprises a radially inwardly curved section 26 which may have a corresponding influence on the external shape of the fabric rosette.

Finally, in the illustrated embodiment the rays 24 of the star-shaped opening 23 in the draping disk 22 are respectively curved, as viewed from above, and especially curved in the same circumferential direction. This also has a corresponding influence on the fabric rosette which can be created by using the device illustrated in FIGS. 11 and 12.

Draping by the use of the above-described device can be effected as follows:

First of all, the curtain fabric is concertina-folded or meander-folded to result in a fabric bar or board. Then, the fabric bar is placed over the leg of the L-shaped bracket 21 which leg extends approximately normal to the plane of the holder 20. Then, the curtain fabric is pulled forward through the opening 23 and rays 24 to form a fabric loop and is then fanned out to star shape. Subsequently, the thus fanned out curtain fabric is turned back over the periphery of the holder 20 to thereby form a fabric rosette.

A device for draping curtains will be described with reference to FIGS. 13 to 19, said device comprising a respective holder 30 or 30' for forming a fabric rosette and/or for fixing the curtain material with a predetermined draping (holders 30 and 30' according to FIGS. 17 to 19), a disk-like cover 31 being mounted on the free front end of the holder 30 or 30'. On the side intended for mounting, i.e. on the side presented to the holder 30 or 30', the disk-like cover 31 is formed with a protruding peripheral edge 32 into which a clamping ring 33 can be fitted to thereby firmly clamp a decorative fabric 34 which has been put over the front of the cover and the circumferential edge thereof (see FIGS. 14 and 15).

Figure 14:
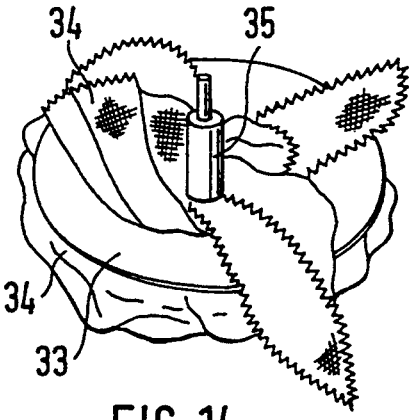

Furthermore, the side of the disk-like cover 31 intended for mounting is provided with a stud 35 for attachment to the holder 30 or 30' (see FIGS. 14, 15 and 17).

The holders 30 and 30' are known per se. They are used to fix curtain fabric with a predetermined draping. The holder 30 shown in FIGS. 17 and 18 is disclosed, for example, in EP-B-265,759.

The cover 31 therefore enables the user to match the front with the drapery of the curtain material.

Figure 20:
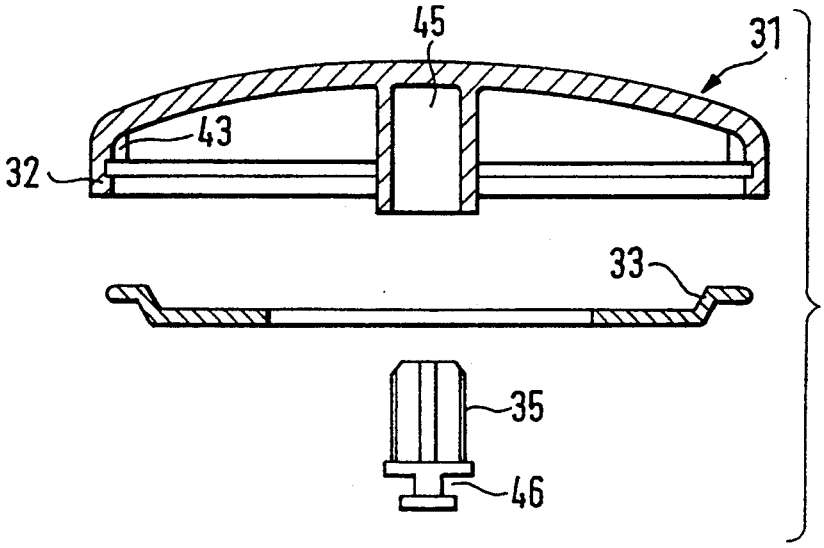
FIGS. 20 and 21 are a cross-sectional view and a rear view of an alternative cover.
Figure 21:
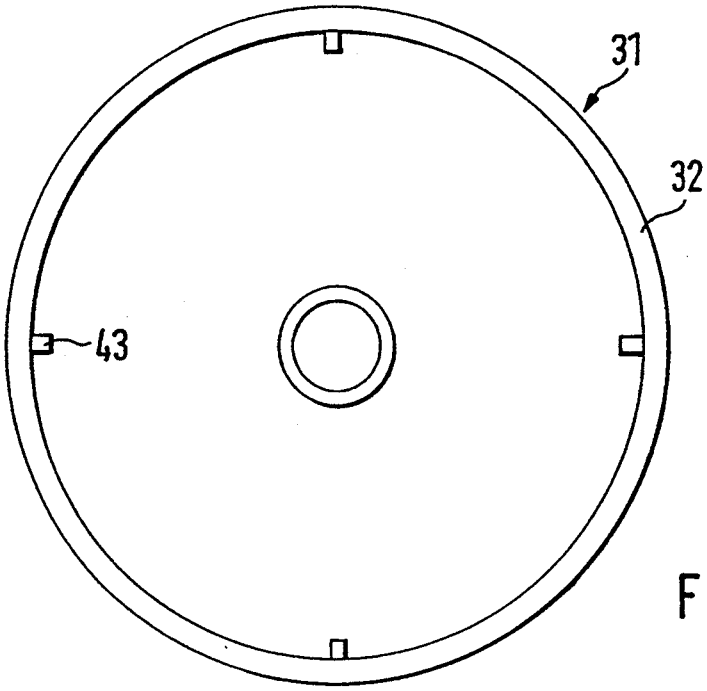

FIGS. 20 and 21 illustrate an alternative design of the cover 31 which is characterized in that the holding ring 33, which is preferentially made of flexibly resilient synthetic plastic, corresponds to stop members arranged within the periphery 32 in the form of four circumferentially equidistantly spaced stop bosses 43 such that the holding ring 33 may be brought to a predetermined clamping position within the cover disk.

Furthermore, the stud 35 for fixing the cover 31 to a holder 30, 30' or some other ornamentation element can be screwed into a central threaded opening 45 at the rear of the cover disk 31. The free portion of the stud 35 protruding from the threaded opening 45 is formed with a radial recess 46 for fitting and fixing in a keyhole-like opening in the holder 30, 30' or some other ornamentation element. Assembly or removal of the cover 31 is thereby greatly facilitated.

Figure 22:
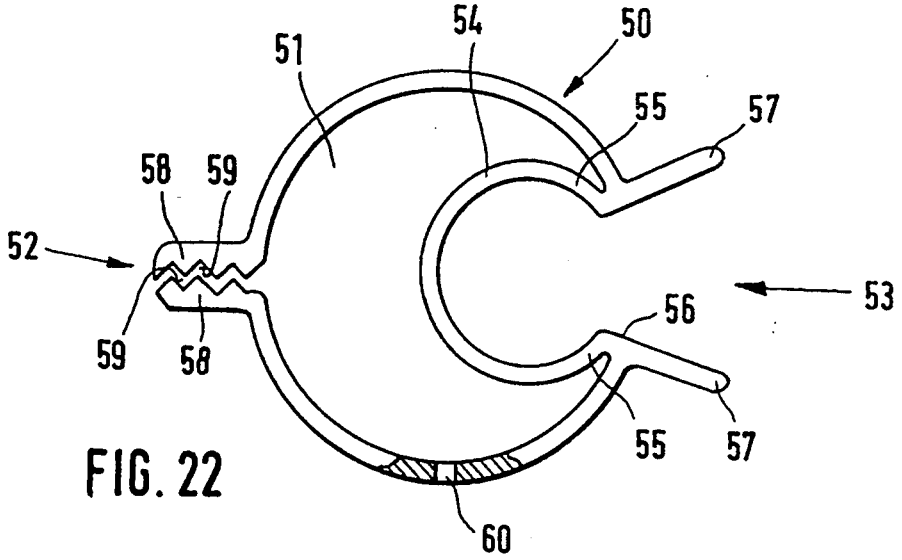
FIG. 22 is a partially cut-away side view of a further embodiment of a draping device according to the invention.

FIG. 22 illustrates a device for draping curtains which comprises a holder 50 intended for fixing of the curtain fabric 38 (not illustrated) with predetermined folds or draping. The holder 50 is preferentially made of resiliently flexible synthetic plastic, a metal such as spring steel, or the like. A disk-like cover 31 is also disposed on the holder 50.

As shown in FIG. 22, the holder 50 is substantially annular or the like. In this way the holder 50 may encompass the curtain fabric 38 which will then lie within the space 51 of the holder 50. Also, the holder 50 is formed with a receiving opening 52 which is spring-loaded and can be spread apart against the spring action for reception therein or removal therefrom of the curtain fabric 38.

A spring 53 or the like is disposed in diametrically opposed relationship to the receiving opening 52 of the holder 50. The spring 53 or the like, which is integral with the holder 50, consists of a U-shaped, C-shaped or similarly shaped part 54 the two free ends 55 of which are non-detachably joined to the holder 50. The holder 50 is provided with a spring slot 56 intermediate the two free ends 55 of the part 54 of the spring 53.

The holder 50 further comprises two protrusions 57 or the like which facilitate spreading-apart of the receiving opening 52 against the action of the spring 53. The two protrusions 57, which extend radially outwardly away from the holder 50, are substantially contiguous with the two free ends 55 of the U-shaped, C-shaped or similarly shaped part 54 of the spring 53 immediately laterally of the spring slot 56 formed in the holder 50. In this way the holder 50 can be handled very easily for taking up or removing the curtain material 38.

Finally, the holder 50 is provided with two projecting parts 58 or the like disposed in the vicinity of the receiving opening 52. The projecting parts 58 extend likewise approximately radially outwardly away from the holder 50 and are each formed with a profiling, with serrations 59 or the like for mutual interengagement when the receiving opening 52 is not spread apart. In addition to the spring loading caused by the spring 53 the serrations 59 provide for the additional advantage that the received curtain fabric 38 cannot automatically loosen itself from the holder 50.

Figure 23:
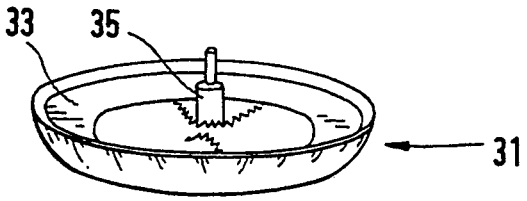
FIG. 23 is a perspective view of an embodiment of a cover according to the invention for a draping device.
Figure 24:
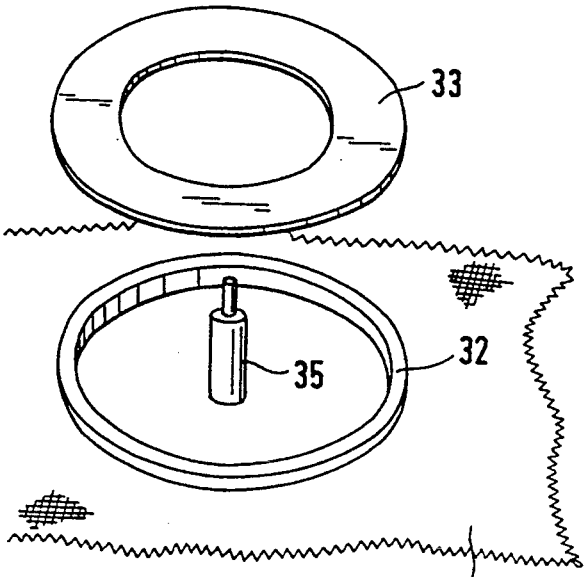
FIG. 24 is an exploded perspective view of the cover of FIG. 23.
Figure 25:
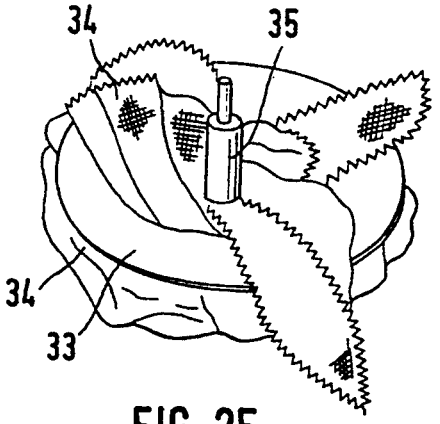
FIG. 25 is a perspective rear view of the cover of FIG. 23 illustrating the fixing of the curtain fabric which has been put over the front of the cover.

The holder 50 is formed with at least one hole 60 for accommodating a pin or stud 35 for attachment of the disk-like cover 31 according to FIG. 23. Preferentially, the hole 60 is approximately equi-spaced from the receiving opening 52 and from the spring slot 56. The disk-like cover 31 is especially distinguished by a particularly easy assembly according to FIGS. 24 and 25 which corresponds to that shown in FIGS. 13 to 17. Such especially easy assembly permits the disk-like cover to be provided with a coating which may for instance be matched with the colour of the respective curtain fabric 38.

Draping by the use of the above-described device may be effected as follows:

First of all, the curtain fabric 38 is concertina-folded or meander-folded to provide a fabric bar or board 39 and is then encompassed by the holder 50. During this operation the holder 50, which due to the spring loading automatically returns to its initial position, is spread apart manually against the action of the spring to receive the fabric bar or board 39. In this way the predetermined folds or draping of the curtain fabric 38 can easily be maintained with the help of the holder 50 according to the invention.

Figure 26:
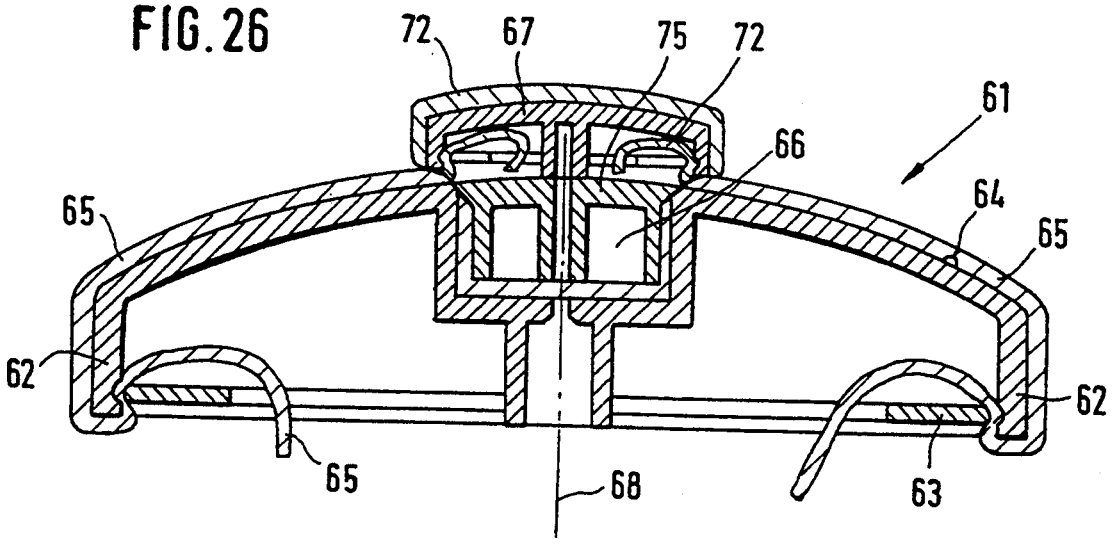
FIG. 26 is a cross-sectional view of another embodiment of a cover.
Figure 27:
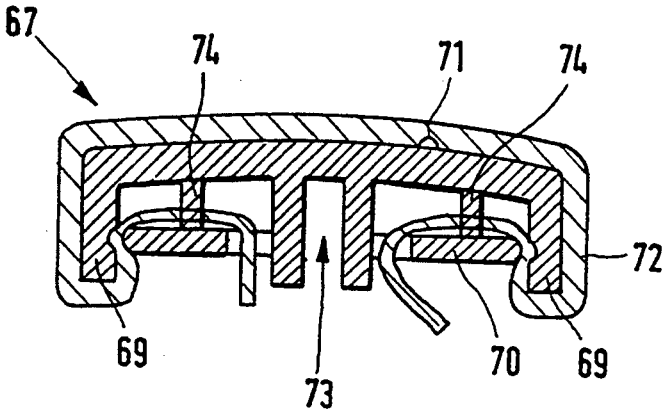
FIG. 27 is a cross-sectional view of a portion of the cover of FIG. 26.
Figure 28:
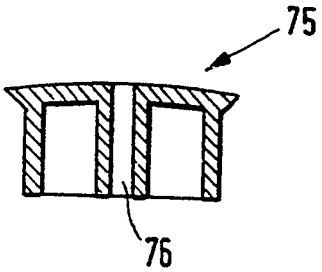
FIG. 28 is a cross-sectional view of another portion of the cover of FIG. 26.

FIGS. 26 to 28 illustrate another device for draping curtains which is comprised of a holder 30, 30', 50 (not illustrated) designed for creating a fabric rosette and/or for fixing the curtain fabric with predetermined folds or draping and which is provided with a disk-like cover 61.

On the side intended for mounting, which is the rear side, the disk-like cover 61 comprises a protruding peripheral skirt 62 into which a holding ring 63 may be fitted. The holding ring 63 firmly clamps an ornamental fabric 65 put over the front 64 of the cover 61 and its peripheral skirt 62. The disk-like cover 61 is further provided on its front with a substantially central receiving opening 66 or the like in which a further disk-like, approximately button-shaped cover 67 can be mounted. The diameter of the further disk-like cover 67 is smaller than that of the disk-like cover 61.

The further, reduced-diameter disk-like cover 67 engages the front 64 of the disk-like cover 61 and is detachably connected to the disk-like cover 61 by way of a fastening element 68 which passes through the receiving opening 66 or at least extends into said opening. A screw or the like (which is merely indicated as a dash-dot line in FIG. 26) is provided as said fastening element 68. The screw is operated from the rear or mounting side of the disk-like cover 67 so as to fix the further disk-like cover 67 to the disk-like cover 61. As an alternative, the fastening element may as well be a non-illustrated latching means or snap-type means or similar means, for instance in the form of detents formed on the further disk-like cover 67 for cooperation with protrusions provided on the rear or mounting side of the disk-like cover 61, or vice versa.

The further disk-like cover 67 itself is provided on the mounting or rear side with a projecting peripheral skirt 69 into which a holding ring 70 may be fitted for firmly clamping an ornamental fabric 72 put over the front 71 of the cover 67 and its peripheral skirt 69. The further disk-like cover 67 is additionally formed with a receiving opening 73 for the fastening element 68 in the form of a screw for attaching the cover 67 to the cover 61. The holding ring 70 corresponds to stops in the form of stop dogs 74, stop bars or the like provided within the peripheral skirt 69 of the further disk-like cover 67 such that the holding ring 70 may be moved to a predetermined clamping position within the cover 67.

As will be apparent from FIG. 26, a tightening element 75 or the like is inserted into the receiving opening 66 of the disk-like cover 61 for additionally tightening, or optionally providing folds in, the decorative fabric 65 which is put over the front 64 of the cover 61 and its peripheral skirt 62. The tightening element 75 is adapted to be clamped or the like in the receiving opening 66 simultaneously with the mounting of the further disk-like cover 67 on the disk-like cover 61. As illustrated in FIG. 28, the tightening element 75 has a through-hole 76 formed therein for engagement therethrough by the fastening element 68 in the form of latching means, snap-type means or similar means, which in the instant case is a screw.

Draping by making use of the aforementioned device is effected as follows:

The decorative fabric 65 is put over the front 64 and the peripheral skirt 62 of the disk-like cover 61. Then, the decorative fabric 65 projecting beyond the peripheral skirt 62 of the cover 61 is bundled, the bundled decorative fabric 65 is threaded through the holding ring 63, and finally the threaded decorative fabric 65 is firmly clamped by the holding ring 63 which is adapted to be moved in operative engagement with the inside of the peripheral skirt 62. Thereafter, the decorative fabric 65 projecting beyond the holding ring 63 is removed, such as by mechanical separation with the help of scissors. Then, the tightening element 75 is inserted into the receiving opening 66 whereby the decorative fabric 65 resting on the front 64 of the cover 61 is placed into the receiving opening 66 and is in particular pressed and consequently tightened and/or optionally folded. The further decorative fabric 72 is put across the front 71 and the peripheral skirt 69 of the further disk-like cover 67. The decorative fabric 72 projecting beyond the peripheral skirt 69 of the cover 67 is then bundled, the bundled decorative fabric 72 is threaded through the holding ring 70, and the threaded decorative fabric 72 is again firmly clamped by the holding ring 70 which is itself brought into operative engagement with the inside of the peripheral skirt 69. The decorative fabric 72 projecting beyond the holding ring 70 is again removed. Finally, the further disk-like cover 67 is placed approximately centrally on the decorative fabric 72 resting on the front 64 of the cover 61 and is joined, especially detachably joined, to the disk-like cover 61 together with the tightening element 75 via the fastening element 68. The fastening element 78, which in the instant case is a screw, is passed through the receiving opening 66 and the through-hole 76 of the tightening element 75. In this way a disk-like cover 61 may additionally be provided with a further disk-like, approximately button-like cover 67 each of which is provided with an optionally different decorative fabric matched with the ornaments or colours of the respective curtain material. Also, the tightening element 75 enables the decorative fabric 65 of the disk-like cover to be additionally tightened so as to have a smooth surface, on the one hand, and to be provided with folds, on the other hand.

All of the features disclosed in the present application papers are claimed as being essential to the invention to the extent to which they are novel over the prior art either individually or in combination.

I claim:

1. A device for draping curtains, comprising:

a holder for fixing curtain fabric with a predetermined folding, said holder having a mounting end and a supporting end;

a disk-like cover having a front and a rear surface whereby said rear surface is supported on the supporting end of the holder; and a holding ring selectively mounted relative to said disk-like cover, said disk-like cover including a peripheral skirt protruding rearwardly from said rear surface for receiving said holding ring to thereby firmly clamp decorative fabric positioned over the front surface of the disk-like cover and the peripheral skirt and trapped between the peripheral skirt and rear surface and said holding ring.

2. The device according to claim 1, wherein the disk-like cover includes a pin for attachment to the holder.

3. The device according to claim 1, wherein the holding ring corresponds to stop members in the form of stop dogs provided within the peripheral skirt of the disk-like cover such that the holding ring is adapted to be brought into a predetermined clamping position within the disk-like cover.

4. A device for draping curtains, comprising:

a holder for forming a fabric rosette;

a disk-like cover having a front and a rear surface whereby said rear surface is supported on the supporting end of the holder; and a holding ring selectively mounted relative to said disk-like cover, said disk-like cover including a peripheral skirt protruding rearwardly from said rear surface for receiving said holding ring to thereby firmly clamp decorative fabric positioned over the front surface of the disk-like cover and the peripheral skirt and trapped between the peripheral skirt and rear surface and said holding ring.

5. The device according to claim 4, wherein the disk-like cover includes a pin for attachment to the holder.

6. The device according to claim 4, wherein the holding ring corresponds to stop members in the form of stop dogs provided within the peripheral skirt of the disk-like cover such that the holding ring is adapted to be brought into a predetermined clamping position within the disk-like cover.

7. The device according to claim 4, wherein the disk-like cover includes a stud for attachment to the holder.

8. The device according to claim 4, wherein the holding ring corresponds to stop members in the form of stop bars provided within the peripheral skirt of the disk-like cover such that the holding ring is adapted to be brought into a predetermined clamping position within the disk-like cover.

9. A device for draping curtains, comprising:

a holder for fixing the curtain fabric with a predetermined folding, said holder having a mounting end and a supporting end;

a disk-like cover having a front and a rear surface whereby said rear surface is supported on the supporting end of the holder; and a holding ring selectively mounted relative to said disk-like cover, said disk-like cover including a peripheral skirt protruding rearwardly from said rear surface for receiving said holding ring to thereby firmly clamp decorative fabric positioned over the front of the cover and the peripheral skirt and trapped between the peripheral skirt and rear surface and said holding ring.

10. The device according to claim 9, wherein the disk-like cover includes a pin for attachment to the holder.

11. The device according to claim 9, wherein the holding ring corresponds to stop members in the form of stop dogs provided within the peripheral skirt of the disk-like cover such that the holding ring is adapted to be brought into a predetermined clamping position within the disk-like cover.

12. The device according to claim 9, wherein the disk-like cover includes a stud for attachment to the holder.

13. The device according to claim 9, wherein the holding ring corresponds to stop members in the form of stop bars provided within the peripheral skirt of the disk-like cover such that the holding ring is adapted to be brought into a predetermined clamping position within the disk-like cover.

* * * * *